United States Patent [19]

Marques

[11] 4,448,283

[45] May 15, 1984

[54] PORTABLE FOLD-UP LADDER

[75] Inventor: Salvador A. Marques, Barcelona, Spain

[73] Assignee: Andral Corporation, Williamsville, N.Y.

[21] Appl. No.: 492,487

[22] Filed: May 6, 1983

Related U.S. Application Data

[63] Continuation-in-part of Ser. No. 341,830, Jan. 22, 1982, and a continuation-in-part of Ser. No. 417,382, Sep. 13, 1982, Pat. No. 4,429,766.

[51] Int. Cl.[3] ..... E06C 1/383

[52] U.S. Cl. ..... 182/164; 182/196; 182/211

[58] Field of Search ..... 182/163, 164, 211, 196, 182/197, 198

[56] References Cited

U.S. PATENT DOCUMENTS

| | | | |
|---|---|---|---|
| 189,501 | 4/1877 | Salisbury | 66/120 |
| 303,884 | 8/1884 | Reisener | 182/164 |
| 308,179 | 11/1884 | Linnenbrink | 182/164 |
| 311,661 | 2/1885 | Joynt | 182/164 |
| 1,228,248 | 5/1917 | Rudd | 182/24 |
| 1,644,739 | 10/1927 | McCracken | 182/164 |
| 1,722,844 | 7/1929 | Faulkenberry | 182/163 |
| 2,529,112 | 11/1950 | Steele | 182/164 |
| 3,216,526 | 11/1965 | Cole | 182/163 |
| 3,449,930 | 6/1969 | West et al | 66/120 |
| 3,554,318 | 1/1971 | Knight | 182/163 |
| 3,655,012 | 4/1972 | Hoffmann | 182/163 |
| 3,730,295 | 5/1973 | Deese | 182/163 |
| 3,811,151 | 5/1974 | Kuemmerlin | 182/163 |

FOREIGN PATENT DOCUMENTS

| | | | |
|---|---|---|---|
| 433724 | 8/1935 | United Kingdom | 182/164 |

*Primary Examiner*—Reinaldo P. Machado
*Attorney, Agent, or Firm*—James J. Ralabate

[57] ABSTRACT

A portable and convertible ladder comprising a series of u-shaped modules each movably connected to the other by hinge means, said modules having progressively decreasing widths as they approach the top of the ladder when in an open mode, said modules having a base or rung portion and upright sections, each module having locking means movably positioned in their lower portion, and adapted to form a substantially rigid ladder when in an open mode, each module except for the uppermost module having hinge means at substantially the upper portion of said upright sections, said locking means having a locking member positioned in said lower portion adapted to fit and mate with complimentary male or female member positioned in an adjacent portion of said upright sections, at least a section of the wider of said modules overlapping at their upper vertical portions with the bottom portions of the next adjacent narrower modules, and said locking means and said module hinge means provided in said overlapping portions.

20 Claims, 8 Drawing Figures

PORTABLE FOLD-UP LADDER

This invention relates to ladders, and, more specifically, to ladders that can be easily moved from one location to the other. This application is a continuation in part of Ser. No. 341,830 filed Jan. 22, 1982, and a continuation-in-part of Ser. No. 417,382 filed Sept. 13, 1982 now U.S. Pat. No. 4,429,766.

BACKGROUND OF THE INVENTION

There are used various forms of collapsable and fold-up ladders for both domestic and commercial use. Several of these prior art ladders are very bulky when folded and are extremely difficult to carry. Several of these ladders require time consuming and difficult processes for disengaging the ladder after use. Correspondingly, most of these known ladders are troublesome to set up for use after storage.

The fold-up ladders known on the market today consist of sections of several rungs which are almost of the same length as that of the main base strut or rung of the portable ladder itself. These struts or rungs are linked by clamps to the side rails between which the struts or rungs are placed.

These clamps secure the struts of the main and secondary sections allowing the extension of this secondary section from the main section. By pulling the secondary sections out from the main section along the clamps, the ladder is extended to its maximum width. These ladders are known as extension ladders and have a compacted size of at least the size of the main section. They are often difficult to extend and are even more difficult to compact.

Another design consists in linking both long sections, main and secondary on their ends by a hinged joint.

These ladders are not structurally secure and need to be of a length no shorter than the length of the main section. Nevertheless, this second embodiment is less reliable for the use of the ladder, as the securing lugged nut at the hinges has to exert a great pressure in the aligned position in order to avoid the collapsing of the end of the ladder once it has been subject to the load of the person stepping on the additional top section. Therefore, this model is still less safe than the first. Nevertheless, both show the drawback of the difficulty of handling because of their weight and bulkiness. Neither configuration is small enough to fit into the trunk of a car, or can easily be stored in a garage or shed.

As noted above, the presently available ladders have serious drawbacks when assembling for use, or disengaging for storage. In addition, they are relatively expensive to manufacture and not always structurally reliable when in use.

Typical fold-up ladders are disclosed in U.S. Pat. Nos. 3,216,526; 3,554,318; 3,655,012; 3,730,295; and 3,811,151.

SUMMARY OF THE INVENTION

It is therefore an object of this invention to provide a portable ladder devoid of the above noted disadvantages.

Another object of this invention is to provide a portable ladder that is comparatively easy and relatively inexpensive to manufacture.

Another further object of this invention is to provide a compact ladder that is structurally sound, and reliable for both domestic and commercial use.

A still further object of this invention is to provide a fold-up ladder that is relatively compact when folded, is easily stored or carried, and simple to fold down when not in use.

Another further object of this invention is to provide a light-weight ladder that can be easily converted into step ladders of various lengths and designs, even in step ladders where the A-frames are of different lengths.

The foregoing objects and others are accomplished in accordance with this invention by providing a novel fold-up portable ladder which comprises a plurality of u-shaped sections or modules that form both the rungs and side rails of a ladder when assembled. Each section or module is attached and hinged at its lower portion to the next adjacent wider section, the wider modules or sections are movably positioned below each of the narrower modules. Below said hinges are locking latches to fit into and mate with an aperture located in the vertical wall of the said next adjacent section, the lowest of said u-shaped modules or sections being the widest and the top uppermost of said u-shaped sections being the narrowest. Each of said sections in between the top and lowest sections are progressively narrower as they approach the said top section. The latches are spring loaded so that when aligned with and mated into the aperture they will remain in place and securely hold each module in position. To disengage each module, there is positioned in each horizontal rung portion a spring and an external latch release. When the pair of latch releases are pinched toghether, the latch is forced away from said apertures and releases each u-shaped section from the next adjacent section. The vertical or upright arms of each u-shaped section thus are connected to and aligned with the next section by the use of latches located in the horizontal base of each u-shaped section. The latches in the horizontal base are aligned with and fit into the orifice or aperture in each vertical section adjacent to it. Also, the tips of each latch portion are tapered at their ends for easy sliding into each orifice or aperture. The latch releases need not be manipulated when setting up the ladder, only when the ladder is to be folded up after use.

Any suitable material may be used in the construction of the ladder; typical materials are steel, aluminum, other metals, plastics such as polycarbonates, polyurethanes, polyesters, polyvinyl materials, or other suitable polymers or synthetic materials. Also wood, fiber glass, or other synthetic materials may be used if suitable.

The ladder of this invention is structurally sound, and is very compact when folded down. It can fit in the trunk of a car easily, and can be carried without fear of turning sharp corners because of extending ladder portions. The ladder is made up of a plurality of u-shaped modules, each module comprising a base (or horizontal) portion and two vertical (side wall) portions. The top module has an additional rung or horizontal piece above the base portion of its u-configuration. Positioned in each side wall are hinges movably connecting the lower part of a narrow u-shaped module to the upper part of the adjacent wider u-shaped module. Each base portion of the ladder with the exception of the lowest module has a locking means adapted to lock each module together when the ladder is extended or opened for use. This locking means comprises a latch that can movably extend out from the outer ends of the base of each u-shaped module. These latches are spring loaded inside each base portion and can be moved within or beyond the terminal ends of said base portions. When the ladder is to be in its extended position, the latches are moved beyond the base terminal ends and into an aperture located in an adjacent portion of the side walls. When the ladder is to be compacted, the latches are moved within the terminal portions of said base portion and out of contact with the aperture or orifice in the side walls. Each base portion except the lower most module has extending outwardly therefrom latch release means that are movably attached to said latches and are adapted to move said latches in any direction when desired. The preferred release means comprise extensions that can be pinched together when compacting the ladder, and can be pushed away from each other toward the terminal ends of said base portion when extending the ladder for use. These latches are associated with springs which cause them to snap into the apertures when aligned therewith. The springs cause the latches to be easily moved into and out of the apertures when desired.

In one embodiment of the invention, the side walls have grooves to facilitate sliding and folding of one module with the next adjacent module. The wider adjacent module has attached thereto a slide means that fits into the groove and slides up and down the groove depending upon the direction of the exerted force.

In another embodiment of this invention, the side walls have no grooves but are flat and fit in movable juxtaposition with the next adjacent module which also has flat surfaces.

In both of these embodiments, the portion of the locking means comprising the latch and latch release are located in the lower portion of the u-shaped module. Also, both embodiments can be converted to step ladders merely by folding the ladders in approximately the center to form two legs forming an A-shaped step ladder. Any portion of the ladder can be folded away to form step ladders of different leg lengths for use on staris, or on surfaces having different elevations. When compacted or folded down, the ladders have a rectangular configuration wherein each module is fitted inside the next adjacent module. When extended, the ladder is rigid and can be used as any extension ladder is used.

More details of the particulars of these embodiments will be provided in the description accompanying the drawings.

BRIEF DESCRIPTION OF DRAWINGS AND DESCRIPTION OF THE PREFERRED EMBODIMENTS

The preferred embodiments of this invention are illustrated in the accompanying drawings and description.

FIG. I shows a ladder built in accordance with the invention, unfolded so that every modular u-shaped section is aligned with respect to the foregoing one, being fixed through the corresponding retractable securing fasteners or latches. FIG. I also shows the same ladder, after having capsized or folded down its sections, and being adapted to be carried by the user on his shoulder or otherwise.

In FIG. 1, the invention consists in the ladder 1 being made up of a multiplicity of u-shaped modules or sections 2, showing the shape of a rectangular frame lacking of one of the smaller laterals or opened at the top. This defines the true u-shape. Each of said modules has its two vertical arms 3 and horizontal or base portion 4.

Figure 2:
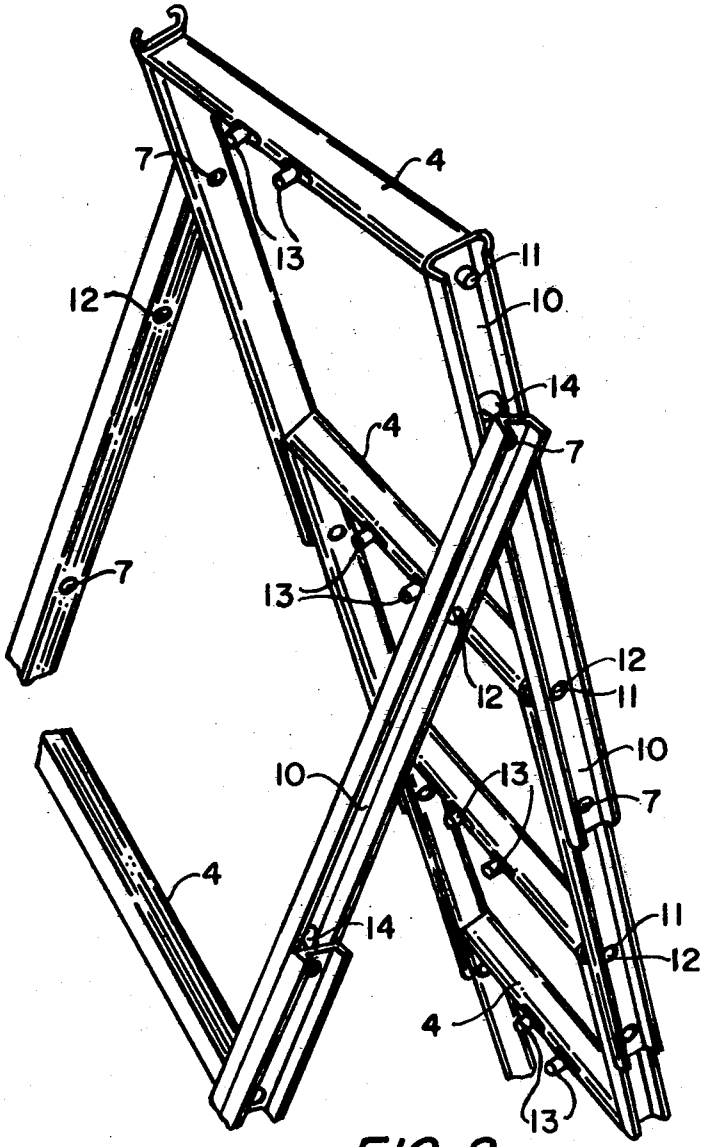
FIG. 2 shows the ladder embodiment having grooved side walls.

Each ladder has a plurality of base portions or horizontal rungs 4 positioned between lowest module base portion 5 and upper module base portion 6. Upper module base portion 6 has above it another horizontal rung or portion 8, and thus is the only module having more than one integral horizontal portion or rung. Each module is movably connected to the next adjacent module by hinge means 7 which are located at the upper portions of side rails or vertical arms 3 and the lower portion of the adjacent narrower u-shaped module. The ladder when it is compacted is folded into a rectangular form as shown at 9. When compacted the ladder takes on the appearance of a plurality of rectangles fitted one inside the other, the rectangle formed by side rails 3 and lower base portion 5 forming the largest or outside rectangle, and the rectangle formed by side rails or vertical arms 3 and upper base portion or horizontal run 6 forming the inner most rectangle. The modules fold upon the hinges 7 when compacted and move open upon the hinges 7 when extended for use in locked position. The modules pivot along hinges 7 and align each of the locking means elements so that they lock in place when the ladder is extended. In FIG. 2, the first embodiment of this invention is shown (set up as a step ladder for clarity) having grooved exterior side walls 10. The locking means comprises latches or side bolt extensions 11. Latches 11 are the male element of said locking means that fit into the apertures 12 when aligned therewith. When disengaging the latches 11 from apertures 12, latch release means 13 are pinched together thereby pulling latches 11 inwardly toward the center of horizontal rungs 4 and away from apertures 12. Apertures 12 are located in side walls 10 and are spaced one from the other in the substantially same distance of each rung 4 from each other. The latches 11 are located in and extend outwardly from rungs 4 and lock each rung or module in position when the ladder is extended. Hinges 7 extend into and are slidably or movably positioned in grooves 10. A cup shaped element is a convenient configuration for hinge slide means 14; however any suitable slide means can be used. Slide means 14 travels into and along grooves 10 until preventing from further movement by the locking of adjacent latches 11 into apertures 12. When the ladder is to be compacted, slide means 14 allow the modules to be folded upon the hinges 7 to form the series of juxtaposed rectangels shown in FIG. 1. Hinge means 7 on one end are fixed to the terminal portions of side rails 3 and on their inner ends are connected to movable hinge slides 14, as shown clearly in FIG. 2. FIG. 2 is the top section of step ladder shown in FIG. 4B.

In FIG. 3, another embodiment of the present invention is shown having flat (ungrooved) side walls 15. The side walls 15 are connected together by hinges 16 which permit the side walls to pivot upon each other and permit 360° movement in relation to each other if desired. Hinge 16 is a bolt or rod flared at each end to securely hold each side wall or vertical arm 15 movably together. Hinges 16 permit free movement of each side wall 15 until latch 17 is aligned with and locked into aperture 18. Apertures 18 can extend through the thickness (as shown at location 20) of side walls 15 or optionally can be placed just in the inside surface as shown at location 19 in the extended portion of the ladder in FIG. 3. Latch release means 21 are movably connected to springs located internally in rungs 4, and said springs are movably attached to latches 17. When release means 21 are pinched together, latches 17 are withdrawn from apertures 18 and the ladder is ready to be compacted or folded up as shown in FIG. 1. When it is desired to extend the ladder for use, rung 8 as shown in FIG. 1, is merely pulled up, holding rung 5 with your foot or any fixed object, and latches 17 because of their rounded ends will lock with the aperture 19 presented to it. Release means 21 need not be manipulated when the ladder is to be extended, only when the ladder is to be compacted. Guide means can be provided in vertical arms 3 adjacent apertures 18 to facilitate latches 17 sliding into apertures 18 if desired. This feature is shown in copending application Ser. No. 341,830 of which this application is a continuation in part. It is not necessary, however, to have these guide means in the embodiments of this invention.

Figure 1B:
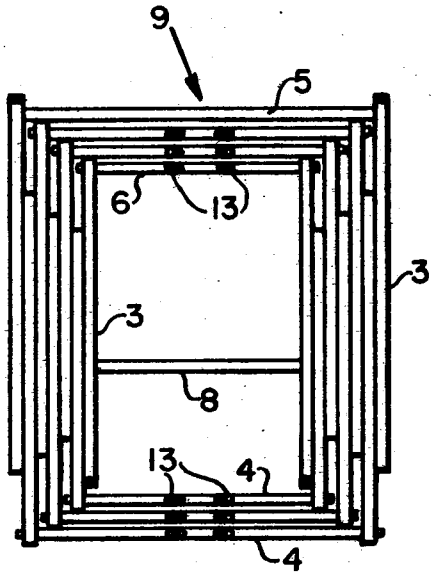
FIG. 1 shows the ladder fully extended in locked position and in its compacted position.
Figure 1A:
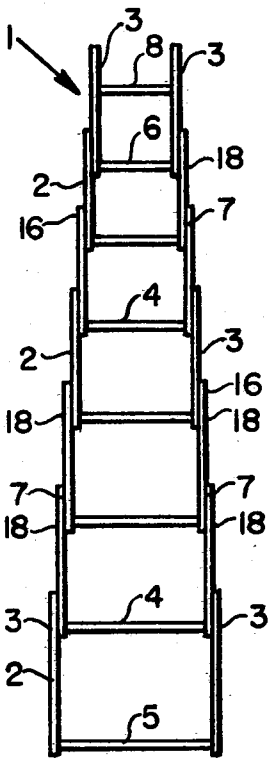
Figure 3B:
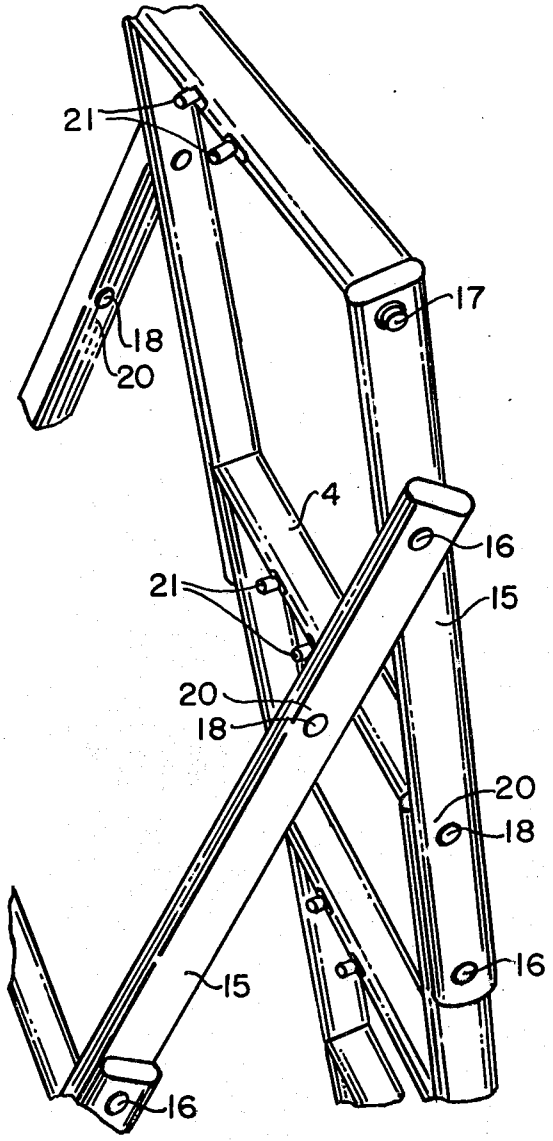
FIG. 3 shows another ladder embodiment having flat side walls but different latch release means in 3A and 3C.
Figure 3C:
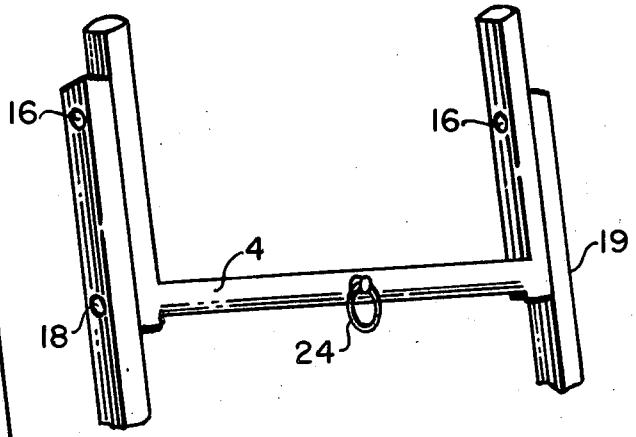
Figure 3A:
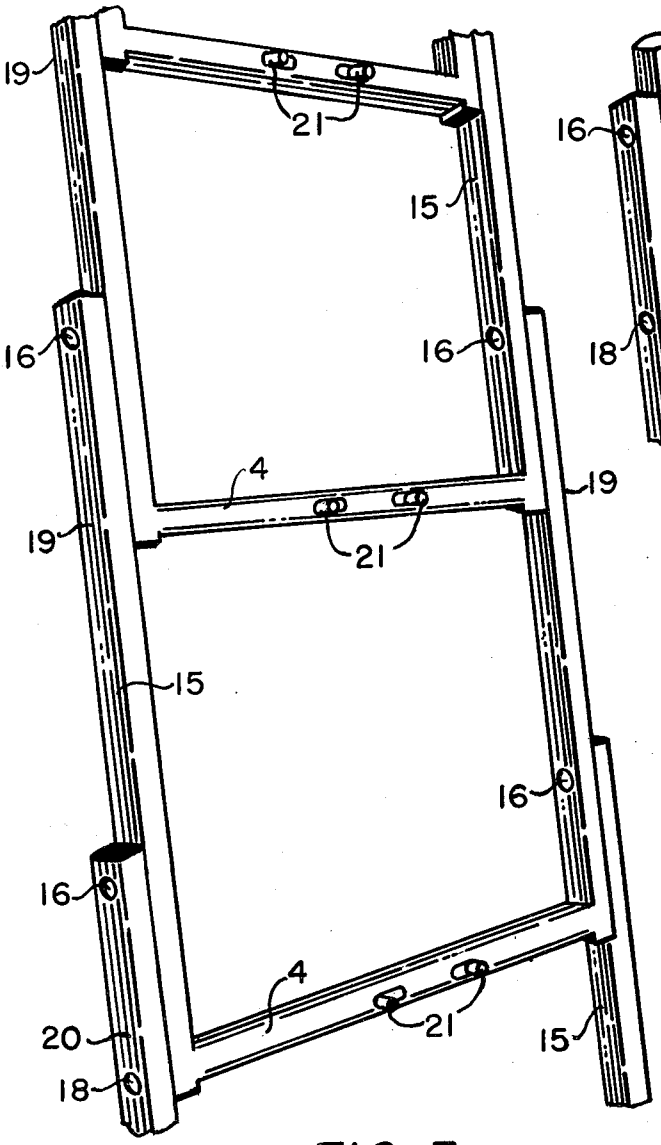

FIG. 3A is a section of the fully extended ladder shown in FIG. 1A. FIG. 3B is the top section of the step ladder shown in FIG. 4A. FIG. 3C shows a ladder with a single latch release means.

Figure 4A:
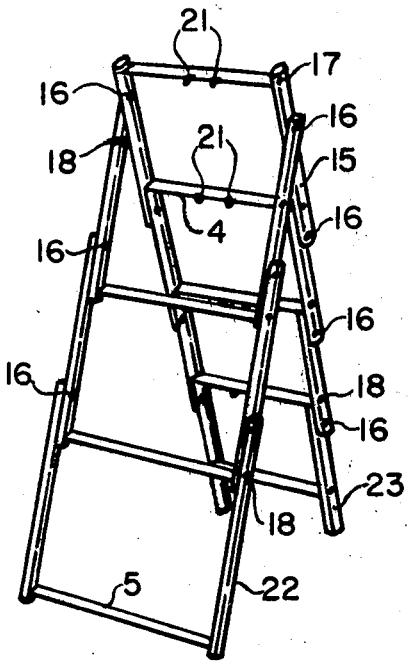
FIG. 4 shows the ladders when they are converted or formed into step ladders.
Figure 4B:
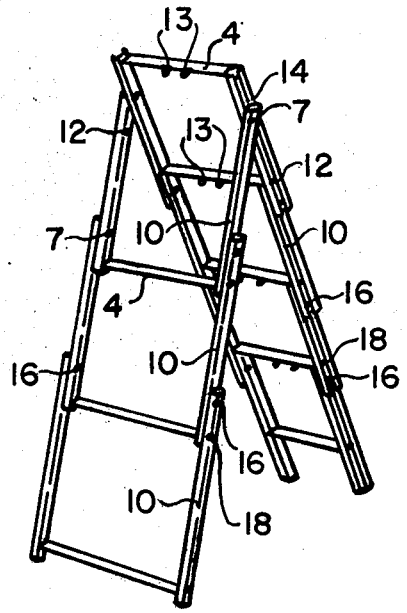

In FIG. 4, embodiments of this invention are shown when converted into step ladders. In FIG. 4A, the top section of this ladder is shown in FIG. 3B. To form the step ladder shown in FIG. 4A, the ladder is merely folded in half with lower base portion 5 as one leg end 22 of the step ladder and top vertical arms 3 adjacent top rung 8 as the other leg 23 of the step ladder. A strap or brace can be placed between these legs if desirable to hold them apart; no such brace is shown here for the purposes of clarity. The A-frame of this ladder has as its focal point hinges 16. A brace of any nature can be placed between A-frame legs 22 and 23. To compact the ladder after use, latch releases 21 are pinched together and the ladder folded as shown in FIG. 1B. FIG. 4B shows the second embodiment where side walls or vertical arms have grooves 10 therein. FIG. 2 shows a close up of the top portion of this embodiment as a step ladder. Both the grooved embodiment (of FIG. 2) and the flat side walls embodiment (of FIGS. 3A and 3B) appear the same when front viewed as in FIG. 1. The side wall difference is only apparent when viewed in side elevation or perspective. Therefore, FIG. 1 can be said to represent both embodiments when frontally viewed. In FIG. 4B, the ladder has as its focal point hinge 7, at top of A-frame. Latches 11 are all locked into position except for the latch 11 located at the top of the A-frame, which does not have an adjacent side wall aperture to lock with. To disassemble or compact the ladder, latch releases 13 are pinched together thus withdrawing the latches 11 from the apertures 12 and permitting the ladder to be folded along hinges 7 into the compact structure shown in FIG. 1B. When the term "convertible ladder" is used herein, it refers to the formation of the ladder into a step ladder configuration as shown in FIGS. 4, 2, and 3B. The ladder, therefore, can be used as both an extension ladder as illustrated in FIG. 1, and as a step ladder, as illustrated in FIGS. 2, 3B and 4.

In each embodiment of this invention, the ladder comprises u-shaped modules, each module comprising two vertical sides, rail, bars or walls 15 and a horizontal rung 4. Positioned in each of said rails 15 are hinges 16 connecting the lower portion of said u-shaped modules to the upper portion of the next adjacent wider module. Locking means are positioned in each u-shaped module to lock with the next adjacent wider module. The locks can be located in any portion of the u-shaped module that allow it to lock with the upper portion of the next adjacent wider module. It is preferred that the latches or locks 17 be in and extend from the horizontal rungs of each module. The locking means comprises a latch male 17 member which extends outward from each rung having a locking means. The female member or latch receiving member 18 is in the form of an aperture 18 located in each of the two vertical side rails of the module. Latch release 24 means are connected to said latches and adapted to move said latches into and out of said latch receiving members. The latch release means may comprise any suitable configuration such as the pinch means 21 shown in FIG. 3A or the single lock release means 24 shown in FIG. 3C. By turning, pinching together, pulling, or otherwise moving said release means, latches are moved into or out of said latch receiving members. The locking means or latches can be located either above or below the hinges in each of the embodiments of this invention. It is preferred that the locking latches be located on the same plane and extend out from the horizontal rungs which are located below each hinge. When the ladder is fully extended, it is rigid and can be used against a wall in the same manner as any extension ladder would be used.

The preferred embodiments of the present invention have been described herein and shown in the accompanying drawings to illustrate the underlying principles of the invention, but it is to be understood that numerous modifications may be made without departing from the broad spirit and scope of the invention.

The spring releases or latch release means can be manipulated both when setting up the ladder for use and when folding up or compacting the ladder for storage or transportation.

The walk up ladder of this invention when extended for use is rigid in substantially the same manner as a conventional ladder or an extension or step ladder. The side rails when in a locked position have substantially the same inflexibility as a rigid side rail when used in an extension or one piece ladder. Thus, the side rails when locked in position simulate a one piece side rail in terms of rigidness, inflexibility and firmness.

When used as a step ladder, the A-frame rails also are as substantially rigid and unyielding as in a conventional step ladder. The stiffness of the vertical side rails or bars when locked and upright permit the use of the ladder in any manner to which conventional one piece or walk-up ladders, extension ladders or step ladders are put.

What is claimed is:

1. A portable folding lean to ladder comprising a plurality of u-shaped modules comprising a rung and two vertical portions, said modules movably connected to each other, and when opened becoming progressively narrower as they approach the top of said ladder, when folded said narrower modules fitting inside of the next wider modules, said modules except for said widest base module comprising in their lower portions a complete module locking means and a module hinge means, said locking means fixing said modules in a rigid manner when said ladder is extended and open, said locking means integral with said modules and comprising latches adapted to movably fit into and mate with an aperture located in the upper sections of said vertical portions of said modules, at least a section of the wider of said modules overlapping at their upper vertical portions with the bottom portions of the next adjacent narrower modules, and said locking means and said module hinge means provided within said overlapping portions.

2. The portable ladder of claim 1 wherein said locking means are adapted to lock with the upper portion of the next adjacent and wider lower module.

3. The portable ladder of claim 1 wherein said hinges are located in the upper portion of said u-shaped modules, and the lower portion of the sequentially adjacent smaller module.

4. The portable ladder of claim 1 wherein said locking means comprise latches adapted to fit into and lock with an aperture located adjacent it in the side rails of said u-shaped modules.

5. The portable ladder of claim 4 wherein said hinges are positioned above said latches in each of said vertical side rails.

6. The portable ladder of claim 1 wherein said locking means comprises spring loaded latches that are adapted to mate with and lock into an aperture located in the adjacent portion of said vertical side rails.

7. The portable ladder of claim 1 wherein said vertical side rails comprise grooves into which the side rails of the next adjacent module slides when in an unlocked mode.

8. The portable ladder of claim 1 wherein said outer vertical side rails are in juxtaposition with the inner vertical side rails of the next wider u-shaped module.

9. The portable ladder of claim 1 wherein said locking means comprise latches, latches release means, and latch receiving apertures, said latch release means connected to said latches and said latches adapted to be moved into and out of said latch receiving apertures.

10. A portable and convertible ladder comprising a series of u-shaped modules each movably connected to the other by hinge means, said modules having progressively decreasing widths as they approach the top of the ladder when in an open mode, said modules having a base or rung portion and upright sections, each module having locking means movably positioned in their lower portion, and adapted to form a substantially rigid ladder when in an open mode, each module except for the uppermost module having hinge means at substantially the upper portion of said upright sections, said locking means having a locking member positioned in said lower portion adapted to fit and mate with complimentary male or female member positioned in an adjacent portion of said upright sections, at least a section of the wider of said modules overlapping at their upper vertical portions with the bottom portions of the next adjacent narrower modules, and said locking means and said module hinge means provided in said overlapping portions.

11. The ladder of claim 10 wherein said hinges are positioned in and connect the lower portion of said u-shaped module and in the upper portion of the adjacent wider u-shaped module.

12. The ladder of claim 10 wherein said hinges are positioned above said locking means in all except the upper most u-shaped module.

13. The ladder of claim 10 wherein said locking means comprise a latch male member, a latch release means and latch receiving female member, said latch release means movably connected to said latches and adapted to move said latches into and out of locking relationship with said latch receiving members.

14. The ladder of claim 13 wherein said latch release means are located externally of the terminal portions of said base sections of said u-shaped modules.

15. The ladder of claim 10 wherein said locking means are below said hinges in each of said modules and are adapted to lock with the upper portion of the next adjacent and wider u-shaped module to thereby form a ladder having a substantailly rigid configuration.

16. The ladder of claim 10 wherein said modules are adapted to be unlocked to form a step ladder having substantially rigid equal or unequal leg sections.

17. The ladder of claim 10 wherein the inner surface of said upright sections fit over and are in juxtaposition to the lower surface of the next adjacent narrower u-shaped module.

18. The ladder of claim 10 wherein said ladder is adapted to be extended and locked in position to form thereby a substantially rigid ladder.

19. The ladder of claim 10 wherein the outside vertical surfaces of said upright sections are grooved.

20. The ladder of claim 10 wherein said ladder is adapted to be compacted and reduced in size when not in use.

* * * * *